United States Patent [19]

Marchesi

[11] Patent Number: 4,924,559

[45] Date of Patent: May 15, 1990

[54] MONOLITHIC DISK-LIKE ELEMENT IN MATERIAL SENSITIVE TO MAGNETIC ATTRACTION, FOR MAGNETIC BUTTONS

[75] Inventor: Alberto Marchesi, Milan, Italy

[73] Assignee: Minu S.p.A., Busnago Mi, Italy

[21] Appl. No.: 322,257

[22] Filed: Mar. 13, 1989

[30] Foreign Application Priority Data

Mar. 18, 1988 [IT] Italy ..... 19850 A/88

[51] Int. Cl.[5] ..... A44B 21/00; A44B 1/18

[52] U.S. Cl. ..... 24/303; 24/95; 24/691

[58] Field of Search ..... 24/303, 94, 95, 691, 24/687, 688, 49 M; 292/251.5

[56] References Cited

U.S. PATENT DOCUMENTS

| | | | |
|---|---|---|---|
| 1,568,030 | 12/1925 | Wilcox | 24/95 |
| 1,583,472 | 5/1926 | King | 24/691 |
| 1,789,035 | 1/1931 | Carley | 24/691 |
| 1,872,968 | 8/1932 | Kimbell | 24/691 |
| 4,686,749 | 8/1987 | Fukuroi et al. | 24/691 |
| 4,736,494 | 4/1988 | Marchesi | 24/303 |

FOREIGN PATENT DOCUMENTS

| | | | |
|---|---|---|---|
| 0170852 | 2/1986 | European Pat. Off. | 24/303 |
| 1186531 | 8/1959 | France | 24/691 |

*Primary Examiner*—Victor N. Sakran

*Attorney, Agent, or Firm*—Guido Modiano; Albert Josif

[57] ABSTRACT

The magnetic button, comprises a male element and a female element which cooperate magnetically with one another, and fixing elements for rearwardly fixing the male and female elements to flaps of fabric. The male element comprises a disk-like body in material sensitive to magnetic attraction and the female element comprises a disk-like body and a magnetic element for attracting the male element. The male element has, on its rear side, a recess tapering towards a hole for the insertion of a tubular end of a fixing element which has, on the opposite side to the tubular end, a collar adapted to retain a flap of fabric, or of other material, arranged on the rear side of the male element. On the bottom of said recess, at the hole, there is a substantially conical protrusion which penetrates into the tubular end pushed into the recess, through the hole, to open out and upturn the tubular end along the walls of the recess to rigidly associate the fixing element and the male element to one another.

6 Claims, 1 Drawing Sheet

MONOLITHIC DISK-LIKE ELEMENT IN MATERIAL SENSITIVE TO MAGNETIC ATTRACTION, FOR MAGNETIC BUTTONS

BACKGROUND OF THE INVENTION

The present invention relates to a monolithic disk-like element in material sensitive to magnetic attraction, for magnetic buttons.

Various types of magnetic buttons are known, which are adapted to be applied to leather goods such as e.g. handbags, and magnetic buttons which by virtue of particular provisions may also be applied to articles of clothing. Such magnetic buttons generally comprise a male element and a female element which are intended to be fixed onto two flaps which must be mutually associated. In particular, in a widespread solution the male element is constituted by a disk-like body in material sensitive to magnetic attraction, which has a cylindrical protrusion on its front face. The female element is manufactured substantially like the male element with the addition of a permanent magnet clinched or seamed onto its front face around its cylindrical protrusion. The permanent magnet is usually sintered and has the shape of a hollow cylinder so as to encircle said cylindrical protrusion of the female element, and has a greater height than said protrusion so as to define a cylindrical seat intended to also accommodate the cylindrical protrusion of the male element when the latter is arranged facing the permanent magnet. Both the male element and the female element have, on their rear face, fixing elements to associate the male and female elements with the two flaps of the material to be joined.

The Italian utility model patent application No. 21188 B/87, filed on 3/19/1987 in the name of the same Applicant, discloses a magnetic button of the type described above, provided in particular for articles of clothing. In this magnetic button the fixing elements are constituted by a tubular body which has, at one of its longitudinal ends, an outward expansion intended to be accommodated in a seat defined in the rear face of the male or female element. The edge of said seat is upturned on the widening of the tubular body so as to rigidly fix the tubular body to the male element or to the female element. The tubular body is inserted in the flap of fabric to which the male element or the female element must be fixed, and its opposite end with respect to the disk-like body is inserted in a hole of an elastic plate and is flanged outwards so as to couple the elastic plate and fix the disk-like body to the fabric. A cap may be located on the elastic plate and is covered by a dome seamed to the edges of the elastic plate.

This type of magnetic button, though it is particularly suitable for application to articles of clothing and ensures excellent sealing and resistance to humidity, is however relatively complicated to produce.

In the buttons of the considered type there are component parts involved in the main magnetic flux of the button and influencing the magnetic flux circuit and other component parts which are not involved or less involved in the magnetic flux. These other component parts are mainly destined to provide deformable elements for fixing the button on the fabric or leather of the article on which the magnetic button is destined to be applied. The fixing normally occurs by coupling together the fixing elements, such as by riveting deformation or the like. The trend in the art was heretofore to avoid to involve the magnetically involved component parts of the button, in the fixing or anchoring action, so that the fixing elements were entirely made of parts distinct from the magnetically involved parts. This trend was mainly due to the fact that fixing required deformation of the fixing elements, such as by riveting or the like, and it was feared that the subsequent deformation for the coupling purpose of the magnetically involved parts was likely to affect the magnetic flux circuit.

GB-A-2114208 and EP 0170852 show in particular the separation of the deformed fixing elements from the magnetically involved component parts. DE-A-2734218 and FR-A-582564 show male and female coupling types of fixing elements in non magnetic buttons in which the female configuration is socket-like and is not deformable, whereas the male configuration is tubular and is deformable at the moment when the coupling occurs.

It has been found according to this invention that the use of a non deformable socket type configuration in magnetically involved component parts of a magnetic button may solve the constructional, mounting, functional and economical and rationality problems of such type of buttons, without affecting the magnetic flux circuit.

SUMMARY OF THE INVENTION

The aim of the present invention is indeed to provide a magnetic button, in particular for application to articles of clothing, which is simple to manufacture and to apply.

Within this aim an object of the invention is to provide a magnetic button which, though it ensures an excellent aesthetical result, is composed of an extremely small number of parts.

Another object of the invention is to provide a magnetic button which by virtue of its structural simplicity has a reduced production cost with respect to known magnetic buttons.

This aim, as well as these and other objects which will become apparent hereinafter, are achieved by a monolithic disk-like element in material sensitive to magnetic attraction, for magnetic buttons of the type wherein the button has a male structural part and a female structural part connectable to one another as an effect of magnetic attraction, said monolithic disk-like element being adapted to be a component of at least one of said structural parts of the button and having a first magnetically attractable side centrally provided with a core protrusion defining the axis of the disk-like element and a second side, opposite to the first, having fixing configurations provided thereon, characterized in that said fixing configurations provided on said second side of the monolithic disk-like element are of the type which is unalterable in assembly and have the shape of at least one recess with lateral walls defining the opening of the recess and having at least partially a shape defining an undercut surrounding said opening.

BRIEF DESCRIPTION OF THE DRAWINGS

Further characteristics and advantages of the invention will become apparent from the description of a preferred but not exclusive embodiment of the magnetic button according to the invention, illustrated only by way of non-limitative example in the accompanying drawings, wherein.

DESCRIPTION OF THE PREFERRED EMBODIMENTS

Figure 1:
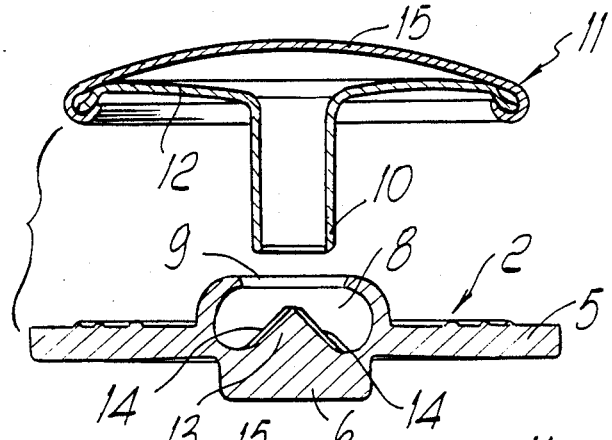
FIG. 1 is a transverse sectional view of the male element of a magnetic button with the fixing element before its application.
Figure 2:
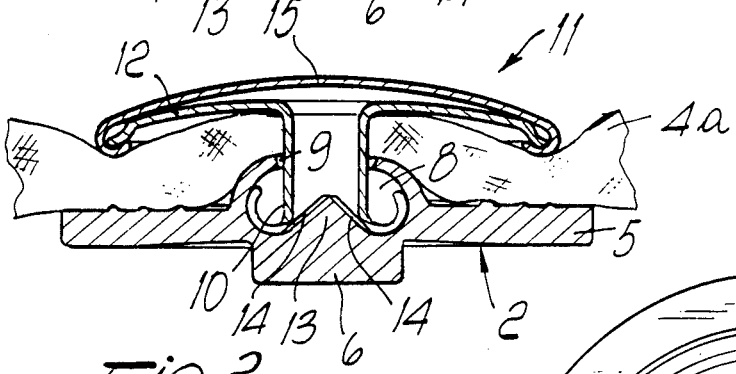
FIG. 2 is a transverse sectional view of the complete male element associated with a flap of fabric.
Figure 4:
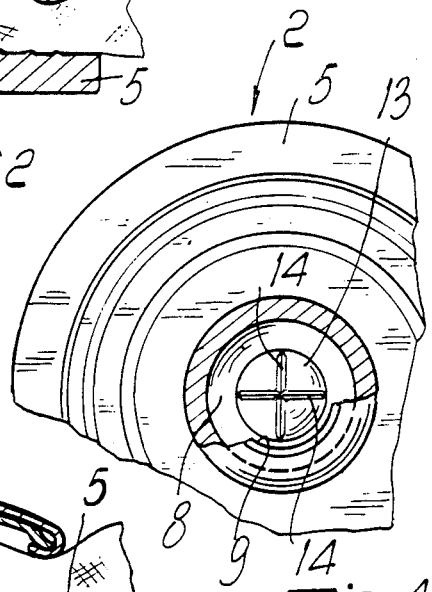
FIG. 4 is a plan view, from the rear side, of the disk-like element which constitutes said male element or said female element.
Figure 3:
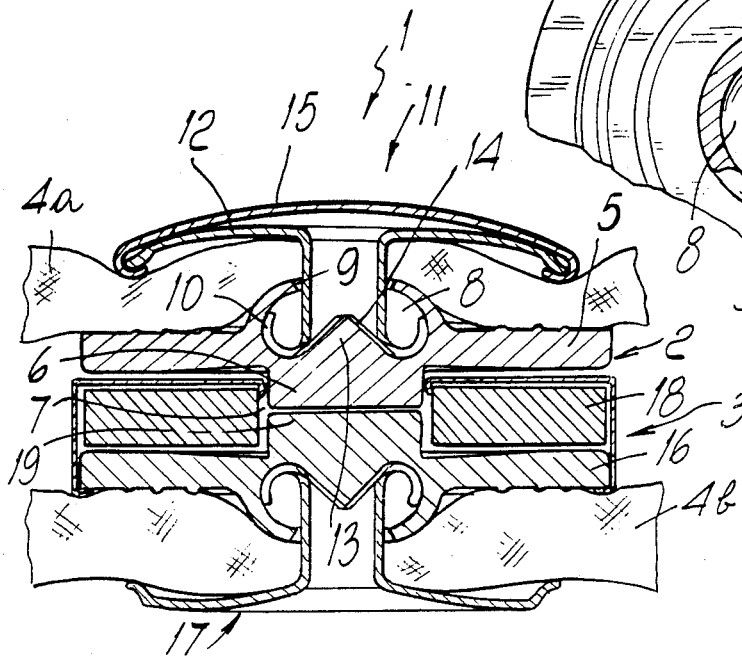
FIG. 3 is a transverse sectional view of a magnetic button according to the invention applied to two flaps of fabric.

With reference to the above described figures, the magnetic button according to the invention, generally indicated by the reference numeral 1, comprises a male element 2 and a female element 3, as well as fixing elements to associate said male and female elements with two flaps of fabric 4a and 4b to be joined by means of the button. The male element, as in known magnetic buttons, comprises a monolithic disk-like body 5 manufactured in material sensitive to magnetic attraction, which has, on its front face which is to be arranged facing the female element 3, a substantially cylindrical protrusion 6 to be accommodated in an adapted seat 7 defined by the female element 3.

According to the invention the male element 2 has, on its rear face, a recess 8, arranged at its axis, which tapers towards a hole 9 having its center on the axis of the male element. A tubular end 10 of a fixing element 11 is inserted in the hole 9 and has at its other end, a collar 12. On the bottom of the recess 8 there is a substantially conical protrusion 13 also arranged along the axis of the male element which penetrates the tubular end of the fixing element 11 pushed into the recess 8, causing the opening out and upturning or flanging of said tubular end along the walls of the recess 8, rigidly associating the fixing element 11 and the male element 2 with one another.

Advantageously, to facilitate the opening of the tubular end 10, on the surface of the protrusion 13 there are four ridges 14 which extend along four mutually angularly spaced directrices of said surface. Furthermore, to facilitate the upturning of said tubular end 10, the walls of the recess 8 are curved and radiused to the protrusion 13, the base diameter whereof is appropriately larger than the inner diameter of the tubular end 10.

Before the fixing element is inserted in the male element it is possible to fit on the collar 12 a dome-like cap 15 which is seamed to the edge of the collar 12. Ornamental patterns or inscriptions may be provided on said dome-like cap, as in known buttons.

The female element 3 is constituted by a disk-like body 16, substantially identical to the disk-like body 5, with which a fixing element 17, substantially identical to the previously described fixing element 11, is associated. Differently from the male element, a cylindrical permanent magnet 18 with an axial cavity which defines a seat 7 to accommodate the cylindrical protrusions 6 and 19 of the male element 2 and of the female element 3 is inclined or seamed on the front face of the female element.

Advantageously, the male element 2, the female element 3 and the fixing elements are manufactured or coated with stainless material, so as to ensure an adequate resistance to the formation of rust during use and when washing the article of clothing with which the magnetic button is associated.

The fixing of the male element to a flap of fabric is provided as follows.

The fixing element 11, already provided with the dome-like cap 15, is pushed so as to pass, with its tubular end 10, through the flap of fabric 4a, arranged on the rear face of the male element 2, and the tubular end 10 is inserted through the hole 9 into the recess 8. By exerting an adequate pressure on the fixing element 11 towards the disk-like body of the male element, the opening out and upturning of the tubular end 10 in the recess 8 is obtained, due to the presence of the protrusion 13, obtaining the fixing of the male element 2 to the flap of fabric 4a which is clamped between the rear face of the disk-like body 5 and the collar 12 of the fixing element 11. The applied pressure also obtains the bending of the collar 12 which increases the adhesion of the button to the flap of fabric to which it is applied.

The fixing of the female element to the other flap of fabric is performed similarly to that of the male element, with the difference that the fixing element 17 associated with the female element may not have the dome-like cap 15 since the collar of the fixing element applied to the female element is arranged on the inner side of the article of clothing.

In practice it has been observed that the magnetic button according to the invention fully achieves the intended aim since by virtue of its structural simplicity it is producible and applicable in a simple and rapid manner to the flaps of fabric of an article of clothing.

Furthermore, by virtue of the fact that the disk-like bodies which constitute the male element and the female element are realized monolithically, a good magnetic-mechanical performance is obtained, reducing the occurrence of dispersed flux lines, obtaining a high attraction force even with low-thickness magnets and therefore allowing the manufacture of thinner buttons, as required in the case of articles of clothing in fabric.

The magnetic button thus conceived is susceptible to numerous modifications and variations, all within the scope of the inventive concept; furthermore all the details may be replaced with other technically equivalent elements.

In practice, the materials employed, so long as compatible with the specific use, as well as the dimensions, may be any according to the requirements and to the state of the art.

I claim:

1. Monolithic disk-like element in material sensitive to magnetic attraction, for magnetic buttons of the type wherein the button has a male structural part and a female structural part connectable to one another as an effect of magnetic attraction, said monolithic disklike element being adapted to be a component of at least one of said structural parts of the button and having a first magnetically attractable side centrally provided with a core protrusion defining the axis of the disk-like element and a second side, opposite to the first, having fixing configurations provided thereon, wherein said fixing configurations provided on said second side of the monolithic disk-like element are of the type which is unalterable in assembly and have the shape of at least one recess with lateral walls defining the opening of the recess and having at least partially a shape defining an undercut surrounding said opening, wherein said recess comprises a bottom surface and wherein said opening of the recess is above said bottom surface, said recess having, below said opening, a greater diameter than that of said opening so that said opening tapers towards said opening to form said undercut recess around said opening and wherein said bottom surface of the recess has a protrusion with lateral walls at least partially converging towards said opening.

2. Element according to claim 1, wherein said protrusion has conical lateral surfaces and being arranged coaxial to the opening of the recess and to the axis of the disk-like element.

3. Element according to claim 1, wherein said protrusion has at least one ridge extending along a generatrix of its conical surface.

4. Element according to claim 3, wherein said protrusion has four of said ridges.

5. Element according to claim 1, wherein said recess has vault-like curved walls which connect to said protrusion.

6. Monolithic disk-like element in material sensitive to magnetic attraction, for magnetic buttons of the type wherein the button has a male structural part and a female structural part connectable to one another as an effect of magnetic attraction, said monolithic disk-like element being adapted to be a component of at least one of said structural parts of the button and having a first magnetically attractable side centrally provided with a core protrusion defining the axis of the disk-like element and a second side, opposite to the first, having fixing configurations provided thereon, wherein said fixing configurations provided on said second side of the monolithic disk-like element are of the type which is unalterable in assembly and have the shape of at least one recess with lateral walls defining the opening of the recess and having at least partially a shape defining an undercut surrounding said opening, wherein said recess comprises a bottom surface and wherein said opening of the recess is above said bottom surface, said recess having, below said opening, a greater diameter than that of said opening so that said opening tapers towards said opening to form said undercut recess around said opening and wherein said bottom surface of the recess comprises wall means facing said undercut.

* * * * *